US005364334A

United States Patent [19]

Inomata

[11] Patent Number: 5,364,334

[45] Date of Patent: Nov. 15, 1994

[54] CONTINUOUS PAPER FOLDING DEVICE FOR USE WITH PRINTER

[75] Inventor: Kiyoshi Inomata, Kawasaki, Japan

[73] Assignee: Fujitsu Limited, Kawasaki, Japan

[21] Appl. No.: 118,436

[22] Filed: Sep. 8, 1993

[30] Foreign Application Priority Data

Mar. 19, 1993 [JP] Japan ..... 5-60003

[51] Int. Cl.[5] ..... B65H 45/20

[52] U.S. Cl. ..... 493/410; 493/422; 493/424

[58] Field of Search ..... 493/410–415, 493/422, 423, 451, 30, 424; 270/40

[56] References Cited

U.S. PATENT DOCUMENTS

| | | | |
|---|---|---|---|
| 3,086,768 | 4/1963 | Lach | 270/79 |
| 4,838,848 | 6/1989 | Lenzi | 493/414 |
| 5,110,101 | 5/1992 | Roth | 493/410 |
| 5,219,321 | 6/1993 | Schwebbach | 493/414 |
| 5,248,291 | 9/1993 | DeNoon et al. | 493/410 |

*Primary Examiner*—Jack W. Lavinder

[57] ABSTRACT

A continuous paper folding device adapted to fold a continuous paper having perforations along which the paper is to be folded. The continuous paper folding device includes a table movable between a storing position where the paper is to be received by the table and a drawn position where the table is drawn from the storing position, and a pair of rotational tapping mechanisms provided on both sides of the table, for rotationally tapping the paper received by the table to forcibly fold the paper along the perforations. Each rotational tapping mechanism includes an upper crank having a pair of first arms spaced from each other and a first shaft connecting the first arms; a lower crank having a pair of second arms spaced from each other and a second shaft connecting the second arms; a blade assembly vertically extending and having a plurality of elastic blades vertically spaced from each other, the blade assembly being rotatably mounted on the first and second shafts of the upper and lower cranks; and a driving mechanism for synchronously rotating the upper crank and the lower crank.

8 Claims, 10 Drawing Sheets

CONTINUOUS PAPER FOLDING DEVICE FOR USE WITH PRINTER

BACKGROUND OF THE INVENTION

1. Field of the Invention

The present invention relates to a continuous paper folding device (stacker) for use with a printer.

2. Description of the Related Art

In association with high speeds of a computer system in recent years, a printer as an output device in the computer system is required to also have high-speed performance and high reliability, and an electrophotographic printer as a printer capable of meeting this requirement is hopeful. As such an electrophotographic printer widely used at present, a laser beam printer and an LED array printer are known, and both printers of different types are capable of performing high-speed printing.

In the electrophotographic printer such as the laser beam printer or the LED array printer, a photosensitive drum is uniformly charged to have a given polarity at the first time. Then, the photosensitive drum is negatively exposed according to image information to form an electrostatic latent image on the photosensitive drum. The electrostatic latent image is reversely developed by using a toner charged to have the same polarity as that of the photosensitive drum, so that the toner electrostatically adheres to an exposed portion on the photosensitive drum to thereby form a toner image.

Then, the toner image formed on the photosensitive drum is transferred onto a continuous paper or a cut paper usually by means of a transferring corotron in a transfer station. In the printer using the continuous paper, it is necessary to provide a continuous paper folding device which can surely fold the continuous paper after printed and stack the folded paper.

In a conventional continuous paper folding device for use with the printer, a table for receiving the continuous paper is vertically movably provided, and a pair of blade wheels for tapping a perforated portion of the continuous paper are provided on both sides of the table to forcibly fold the continuous paper along perforations thereof and stack the folded paper on the table. The height of the continuous paper stacked on the table is detected by a photosensor. When the height becomes a predetermined value or more, the table is controlled to be lowered. However, such a conventional continuous paper folding device is required to include a driving mechanism for vertically moving the table, causing a complex structure of the device and an increase in cost.

To cope with this problem, it may be considered to provide a continuous paper folding device including a table which is vertically unmovable but is allowed to be drawn to the front side of the device. Further, a paper tapping mechanism formed of rubber may be used to tap the perforated portion of the continuous paper received on the table and stack the folded paper on the table. In the paper tapping mechanism, a pair of timing belts with blades for tapping the paper may be provided on both sides of the table. However, when the table is drawn to take out the paper stacked on the table, the paper may be caught by the blades projecting over the table to cause cutting of the paper or disengagement of the timing belts from pulleys.

SUMMARY OF THE INVENTION

It is therefore an object of the present invention to provide a reliable continuous paper folding device which can surely stack a continuous paper on a table without vertically moving the table.

In accordance with an aspect of the present invention, there is provided a continuous paper folding device for folding a continuous paper having perforations along which said paper is to be folded, comprising a frame; a table movable between a storing position where said continuous paper is to be received by said table and a drawn position where said table is drawn from said storing position; and a pair of rotational tapping mechanisms provided on both sides of said table, for rotationally tapping said continuous paper received by said table to forcibly folding said continuous paper along said perforations; each of said rotational tapping mechanisms comprising an upper crank comprising a pair of first arms spaced from each other and a first shaft connecting said first arms; a lower crank comprising a pair of second arms spaced from each other and a second shaft connecting said second arms; a blade assembly vertically extending and having a plurality of elastic blades vertically spaced from each other, said blade assembly being rotatably mounted on said first shaft of said upper crank and said second shaft of said lower crank; and driving means for synchronously rotating said upper crank and said lower crank.

Preferably, the blade assembly comprises a plurality of blade assemblies spaced from each other in an axial direction of the first and second shafts, and each blade assembly is rotated by the driving means between an advanced position where the elastic blades tap the paper and a retracted position where the elastic blades are kept in noncontact with the paper. More preferably, a pair of paper guiding members each having a plurality of vertically extending openings for allowing pass of the elastic blades are provided on both sides of the table.

When the upper crank and the lower crank are synchronously rotated by the driving means, each blade assembly is rotated between the advanced position where the elastic blades tap the paper and the retracted position where the elastic blades are kept in noncontact with the paper. As the elastic blades of each blade assembly while in rotation operate to tap the paper at a perforated portion thereof, the paper can be surely folded along the perforations and stacked in order on the table.

When printing is ended, each blade assembly is rotated to the retracted position to keep the elastic blades away from the paper stacked on the table. Accordingly, the table can be smoothly drawn without interference of the paper with the elastic blades, and the paper stacked on the table can be readily taken out.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
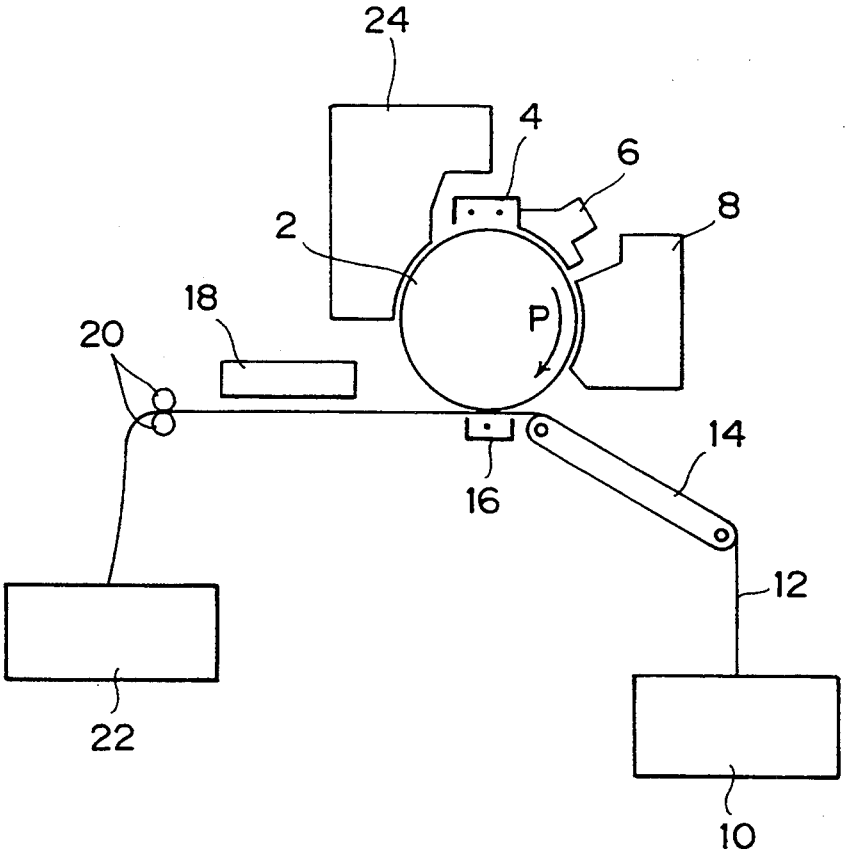
FIG. 1 is a schematic view showing the construction of a printer to which the present invention is applicable.

Referring first to FIG. 1, there is shown a schematic construction of a printer to which the present invention is applicable. A photosensitive drum 2 formed of amorphous silicon or the like is rotationally driven in a direction depicted by an arrow P. The photosensitive drum 2 is uniformly charged to have a predetermined polarity by a charging corotron 4, and an electrostatic latent image corresponding to image information is next formed on the photosensitive drum 2 by a print head 6. The print head 6 is constructed as an LED array having a plurality of LEDs arrayed in an axial direction of the photosensitive drum 2. The electrostatic latent image formed on the photosensitive drum 2 is then developed by using a toner charged to have the same polarity as that of the photosensitive drum 2 by a developing unit 8 such as a magnetic brush developing unit, thus forming a toner image on the photosensitive drum 2.

On the other hand, a continuous paper 12 stored in a paper storing box 10 is fed to a transfer station by driving a tractor 14 in such a manner that a plurality of sprockets of the tractor 14 are engaged with a plurality of sprocket holes formed along both side edges of the paper 12 at a predetermined pitch. In the transfer station, DC corona discharge with a polarity reverse to that of the toner is performed by a transferring corotron 16 from the back side of the paper 12, thereby making the paper 12 adhere to the photosensitive drum 2 and electrostatically transferring the toner onto the paper 12 at the same time.

Then, the residual toner left on the photosensitive drum 2 is cleaned off by a cleaner 24. Thus, one cycle of print operation is finished. The paper 12 on which the toner image has been transferred is further fed to a fuser 18 by a pair of feed rollers 20. After the toner image is fused and fixed by the fuser 18, the paper 12 is further fed to a paper folding unit (stacker) 22, in which the paper 12 is stored under a folded condition.

Figure 2:
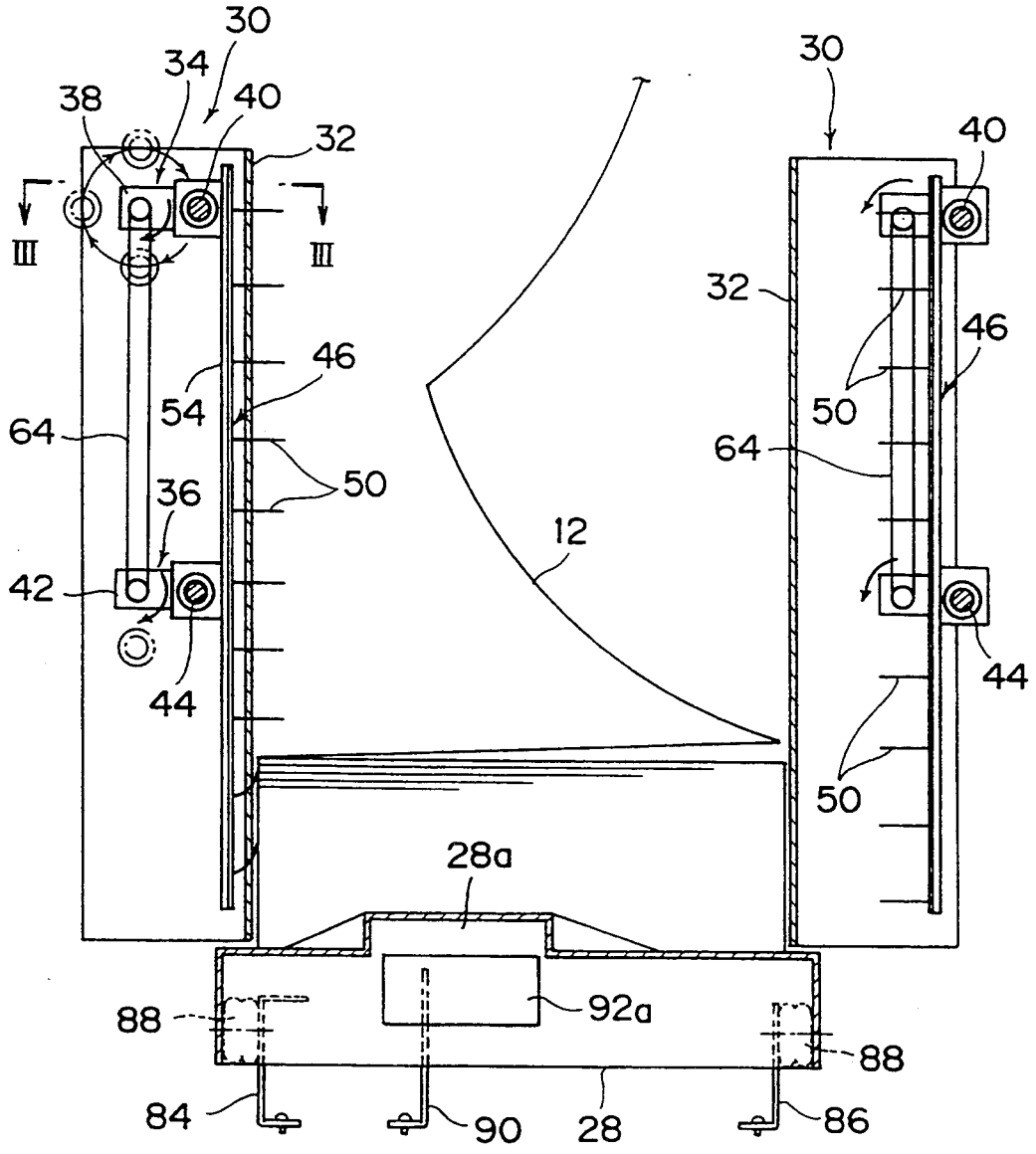
FIG. 2 is a vertical sectional view of a preferred embodiment of the present invention.

The paper folding unit 22 according to a preferred embodiment of the present invention will now be described in detail with reference to FIGS. 2 to 11. Referring first to FIG. 2, reference numeral 28 denotes a table 28 for receiving the continuous paper 12. The table 28 is not movable in a vertical direction, but it is allowed to be drawn to the front side of the unit 22 (i.e., to the upper side of the sheet of FIG. 2). The table 28 is integrally formed with an upper projection 28*a* for the purpose of easy removal of the paper 12 stacked on the upper surface of the table 28. As will be hereinafter described in detail, the table 28 is drawn with the aid of a pair of slide rail assemblies 88, one of which is interposed between a bracket 84 and the table 28 and the other is interposed between a bracket 86 and the table 28.

Figure 3:
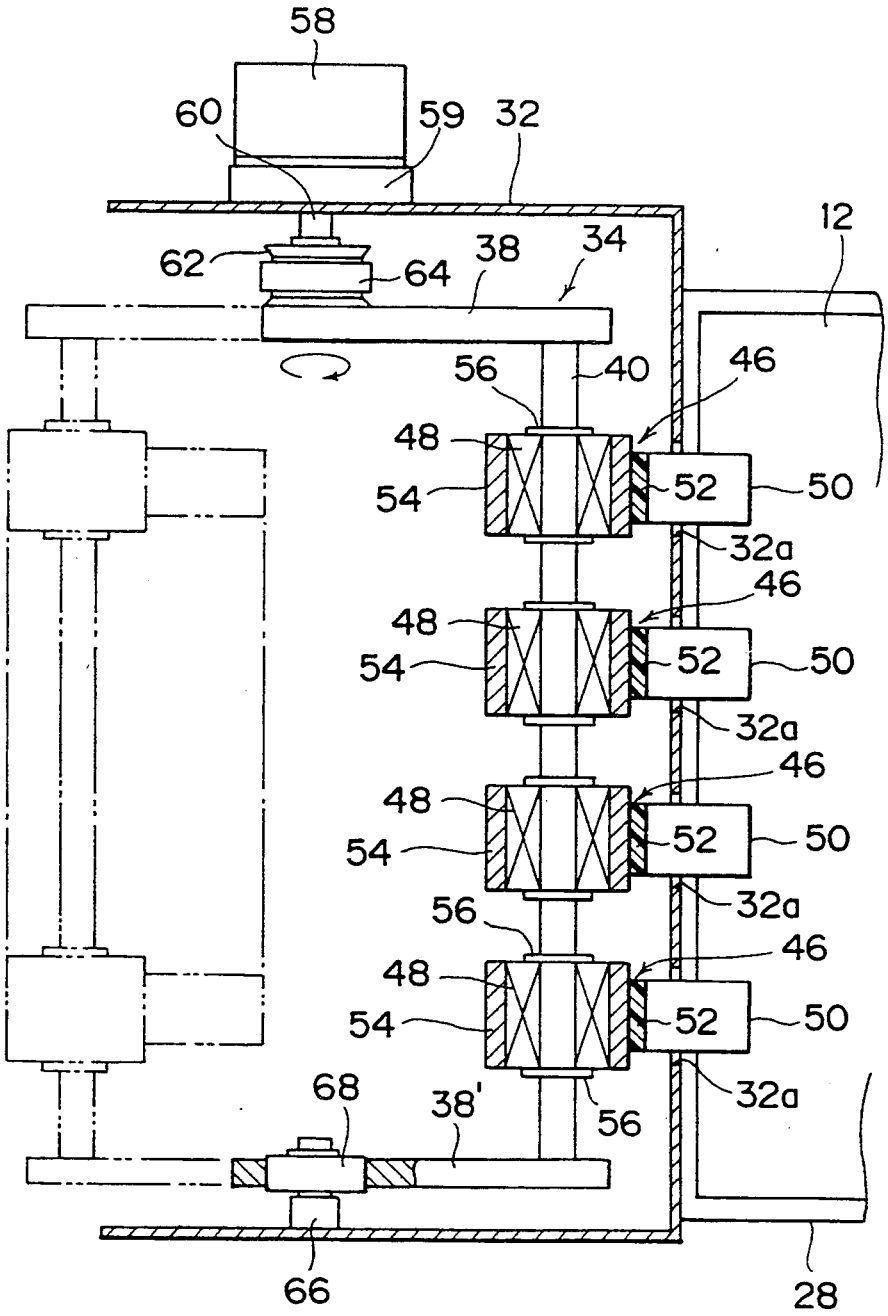
FIG. 3 is a cross section taken along the line III—III in FIG. 2.
Figure 4:
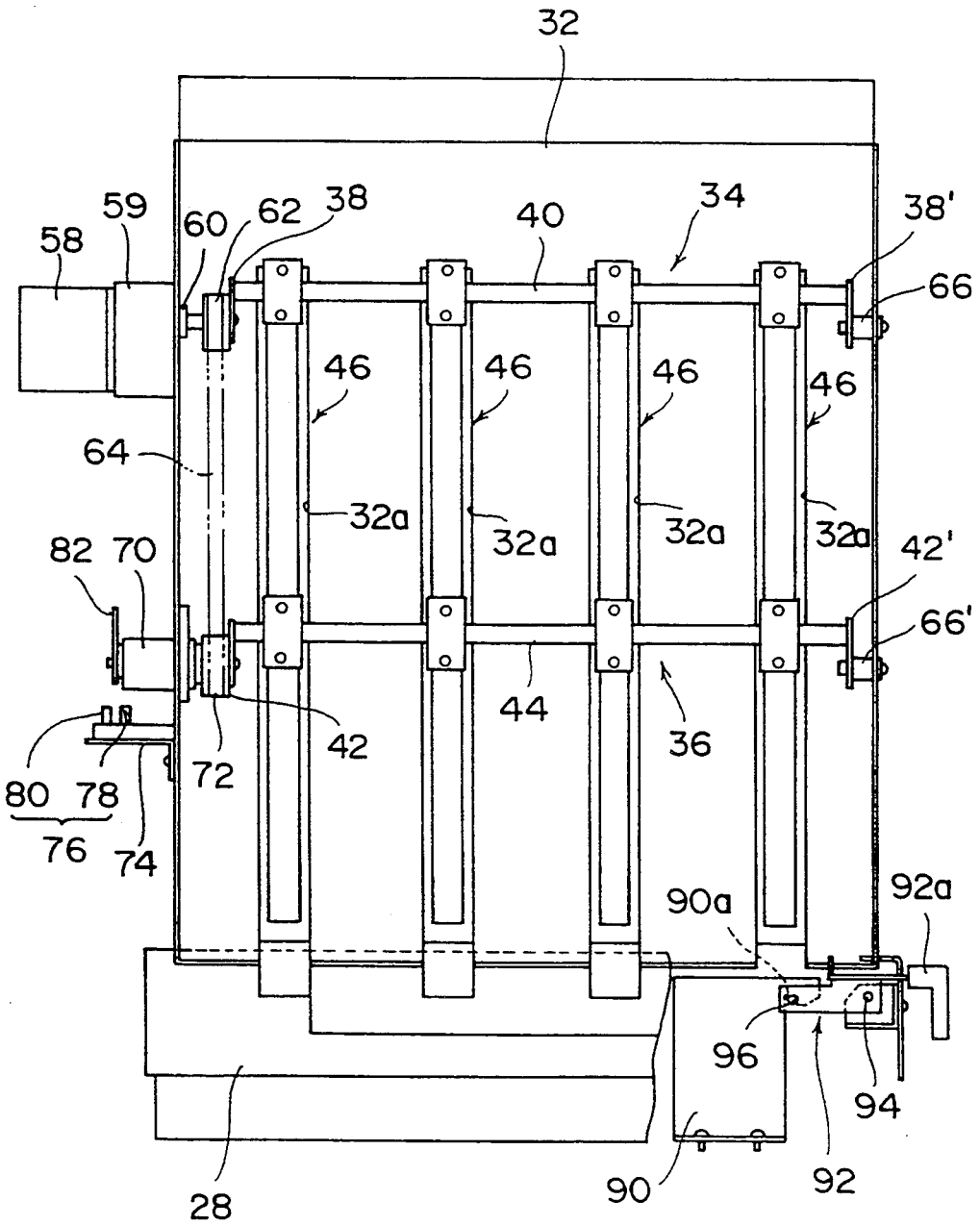
FIG. 4 is a partially cutaway, left side view of FIG. 3, showing a locked condition of a table.

A pair of rotational tapping mechanisms 30 for tapping the paper 12 stacked on the table 28 are provided on both sides of the table 28. The pair of rotational tapping mechanisms 30 are simultaneously rotationally moved between an advanced position where a plurality of elastic blades 50 (to be hereinafter described in detail) tap the paper 12 and a retracted position where the elastic blades 50 are kept in noncontact with the paper 12. In FIG. 2, for the sake of convenience, there are shown the advanced position of the left-hand rotational tapping mechanism 30 and the retracted position of the right-hand rotational tapping mechanism 30. As shown in FIGS. 3 and 4, each rotational tapping mechanism 30 is associated with a paper guide 32 having a plurality of vertically extending openings 32*a* for allowing pass of the elastic blades 50. The paper guide 32 serves to guide the paper 12 so that the paper 12 may be stacked in order on the table 28.

As best shown in FIG. 3, reference numeral 34 denotes an upper crank rotatably mounted to the paper guide 32. The upper crank 34 is constructed of a pair of arms 38 and 38′ and a shaft 40 connecting the arms 38 and 38′. As shown in FIGS. 2 and 4, a lower crank 36 is similarly rotatably mounted to the paper guide 32. The lower crank 36 is similarly constructed of a pair of arms 42 and 42′ and a shaft 44 connecting the arms 42 and 42′.

As shown in FIGS. 2 and 4, a plurality of blade assemblies 46 extend vertically in parallel substantially over the height of the paper guide 32 in such a manner as to be spaced a given distance from each other in an axial direction of the shafts 40 and 44. As best shown in FIG. 3, each blade assembly 46 is rotatably mounted on the shafts 40 and 44 by means of a bearing 48 such as a metal sleeve. Each blade assembly 46 is constructed of a vertically extending blade support 54 and a vertically extending blade unit 52 having a plurality of elastic blades 50. The blade unit 52 is fixed to the blade support 54, and the blade support 54 is mounted through the bearing 48 on the shafts 40 and 44. As shown in FIG. 3, a pair of E-rings 56 are provided to prevent lateral slip of each blade assembly 46 in the axial direction of each of the shafts 40 and 44 with the rotation of each blade assembly 46 being permitted.

Figure 6A:
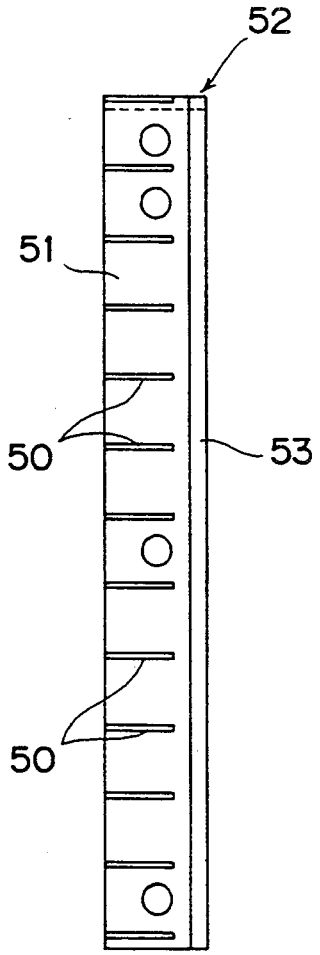
FIG. 6A is a front elevational view of a blade unit.
Figure 6B:
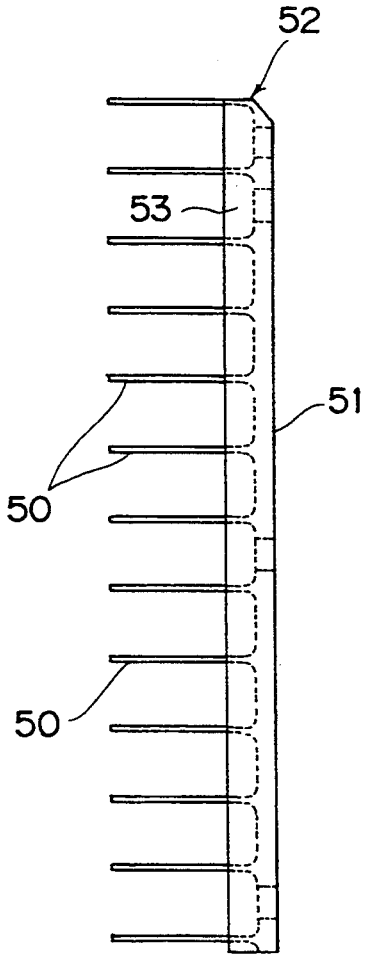
FIG. 6B is a side view of the blade unit.

As shown in FIGS. 6A and 6B, the blade unit 52 is constructed of a plurality of elastic blades 50 vertically spaced a given distance from each other, a bottom plate 51 integrally connecting the elastic blades 50, and a side plate 53 projecting from the side edge of the bottom plate 51 to reinforce the bottom plate 51. The blade unit 52 is formed of urethane rubber having a hardness of about 80, for example.

As shown in FIGS. 3 and 4, a motor (pulse motor) 58 for driving the blade assemblies 46 is mounted on a rear wall of the paper guide 32. An output shaft 60 of the motor 58 is fixed to the arm 38 of the upper crank 34. The other arm 38′ of the upper crank 34 is rotatably mounted through a bearing 68 on a shaft 66 projecting inwardly from a front wall of the paper guide 32. A gear head 59 is connected to the output shaft 60 of the motor 58, and a pulley 62 is fixed to the output shaft 60 connected to the gear head 59. Further, as shown in FIG. 4, a shaft 70 is rotatably mounted to the rear wall of the paper guide 32, and a pulley 72 is fixed to the shaft 70. The arm 42 of the lower crank 36 is fixed to the shaft 70, and the other arm 42' is rotatably mounted through a bearing (not shown) to a shaft 66' projecting inwardly from the front wall of the paper guide 32. The pulleys 62 and 72 are connected together by a timing belt 64.

A photointerrupter 76 is mounted on a bracket 74 fixed to the rear wall of the paper guide 32. The photointerrupter 76 comprises a light emitting diode 78 and a photodiode 80 spaced from each other. A light shielding plate 82 is mounted on the shaft 70 at the outer end thereof. The light shielding plate 82 is adapted to be intermittently inserted between the light emitting diode 78 and the photodiode 80.

Figure 5:
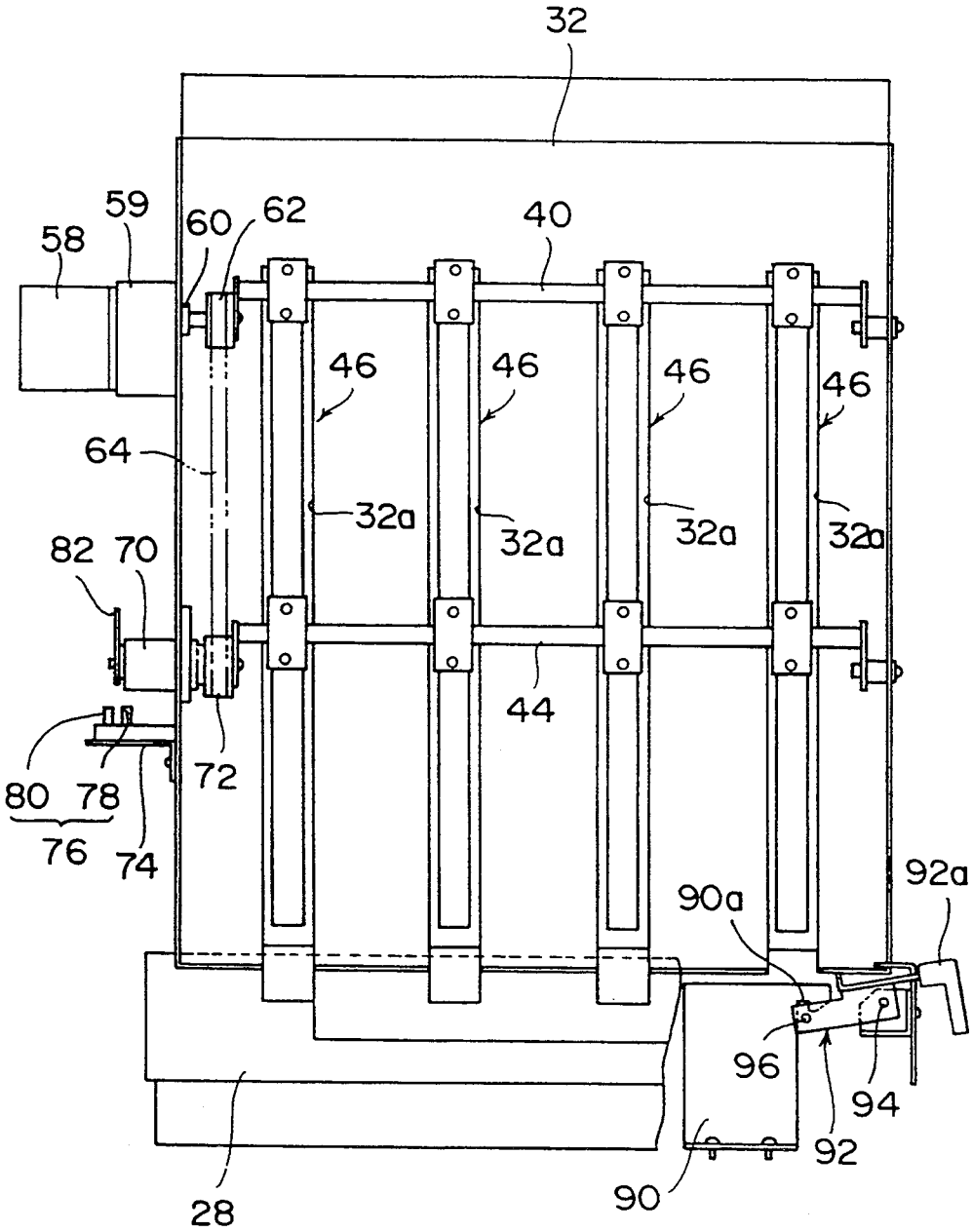
FIG. 5 is a view similar to FIG. 4, showing an unlocked condition of the table.

As shown in FIGS. 2 and 4, a locking member 92 is pivotally mounted inside the front surface of the table 28 so as to be rotatable about a shaft 94. A shaft 96 is fixed to the locking member 92 at the rear end thereof so as to normally engage with a locking recess **90*a* of a bracket 90. Accordingly, when the table 28 is in a normal, or fully pushed condition as shown in FIG. 4, the shaft 96 of the locking member 92 is engaged with the locking recess 90*a* of the bracket 90 to thereby lock the table 28. A handle 92*a* is fixed to the locking member 92 at the front end portion thereof. When the handle 92*a* is lifted as shown in FIG. 5, the shaft 96 of the locking member 92 disengages from the locking recess 90*a* of the bracket 90, so that the table 28 can be drawn to the front side of the unit 22 by frontwardly pulling the handle 92*a***.

Figure 7:
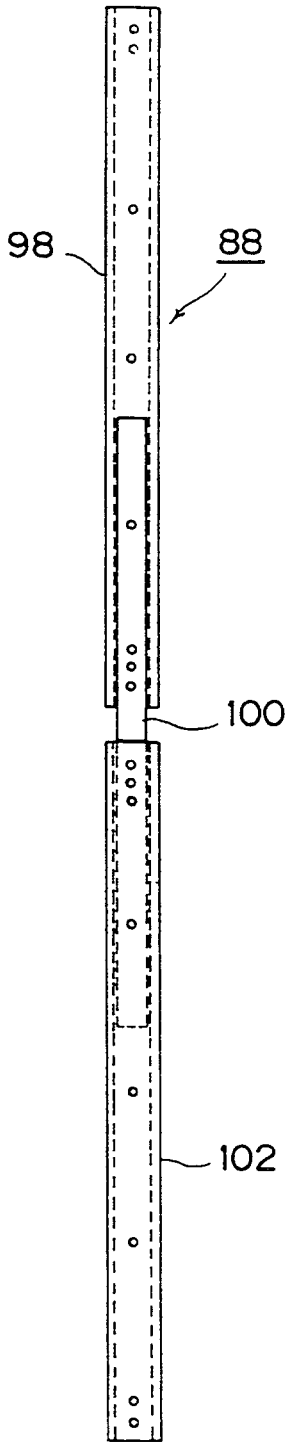
FIG. 7 is a side view of a slide rail assembly.

A detailed structure of each slide rail assembly 88 for guiding the movement of the table 28 will now be described with reference to FIGS. 7 to 9. Each slide rail assembly 88 is constructed of a fixed rail 98 fixed to the bracket 86 (84) shown in FIG. 2, an inner slide rail 100 slidably engaged with the fixed rail 98, and an outer slide rail 102 slidably engaged with the inner slide rail 100. The outer slide rail 102 is fixed to the table 28.

Figure 8A:
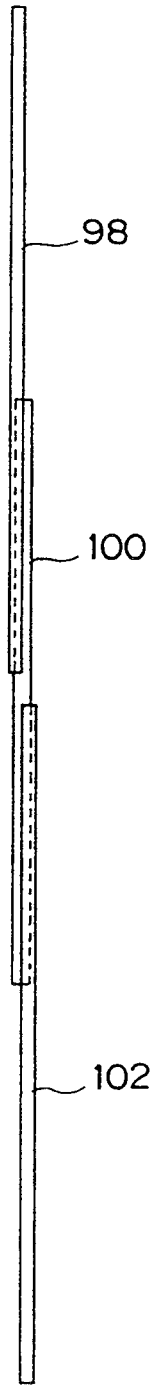
FIG. 8A is a plan view of the slide rail assembly under a fully extended condition thereof.
Figure 8B:
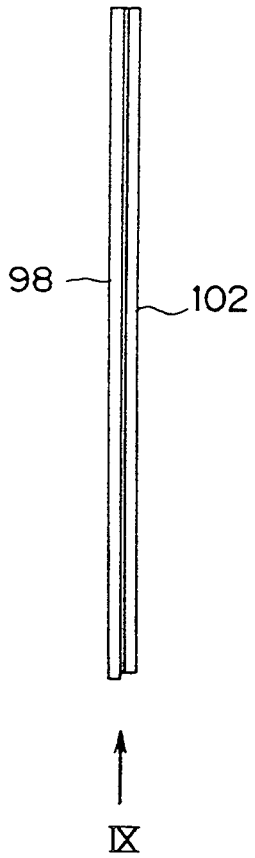
FIG. 8B is a plan view of the slide rail assembly under a full contracted condition thereof.
Figure 9:
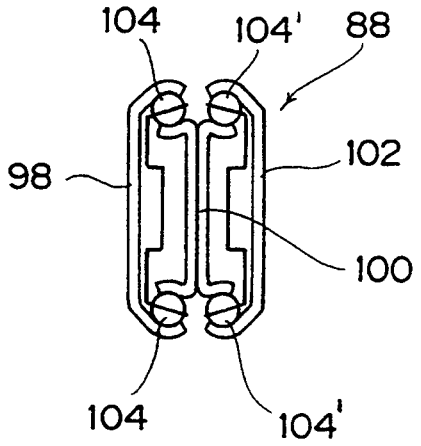
FIG. 9 is a view taken in a direction depicted by an arrow IX in FIG. 8B.

As shown in FIG. 9, bearings 104 are interposed between the fixed rail 98 and the inner slide rail 100 to assist the sliding movement of the inner slide rail 100, and similar bearings 104' are interposed between the inner slide rail 100 and the outer slide rail 102 to assist the sliding movement of the outer slide rail 102. Referring to FIGS. 8A and 8B, there are shown plan views of the slide rail assembly 88, in which FIG. 8A shows a condition where the inner slide rail 100 and the outer slide rail 102 are slid to the fully extended position, and FIG. 8B shows a condition where the inner slide rail 100 and the outer slide rail 102 are slid to the fully contracted position.

Figure 10:
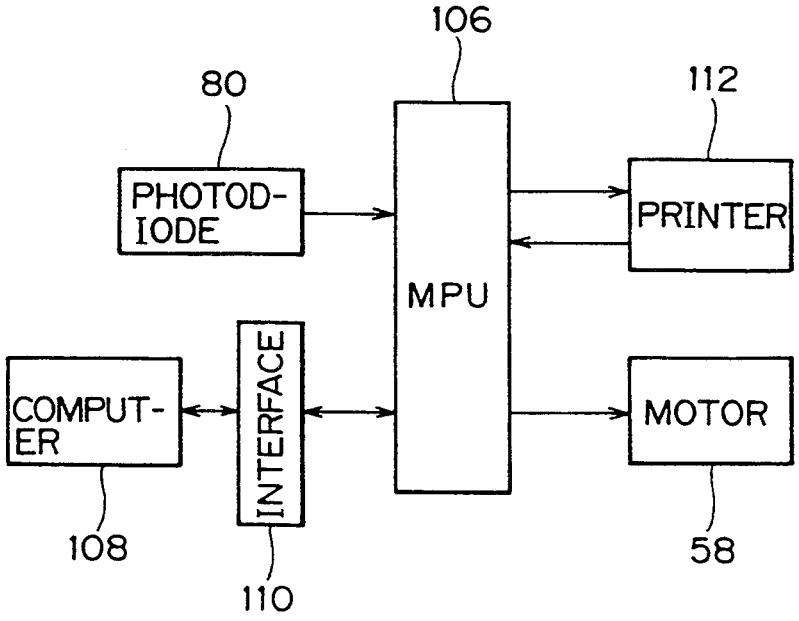
FIG. 10 is a schematic block diagram of a control system according to the preferred embodiment of the present invention.
Figure 11:
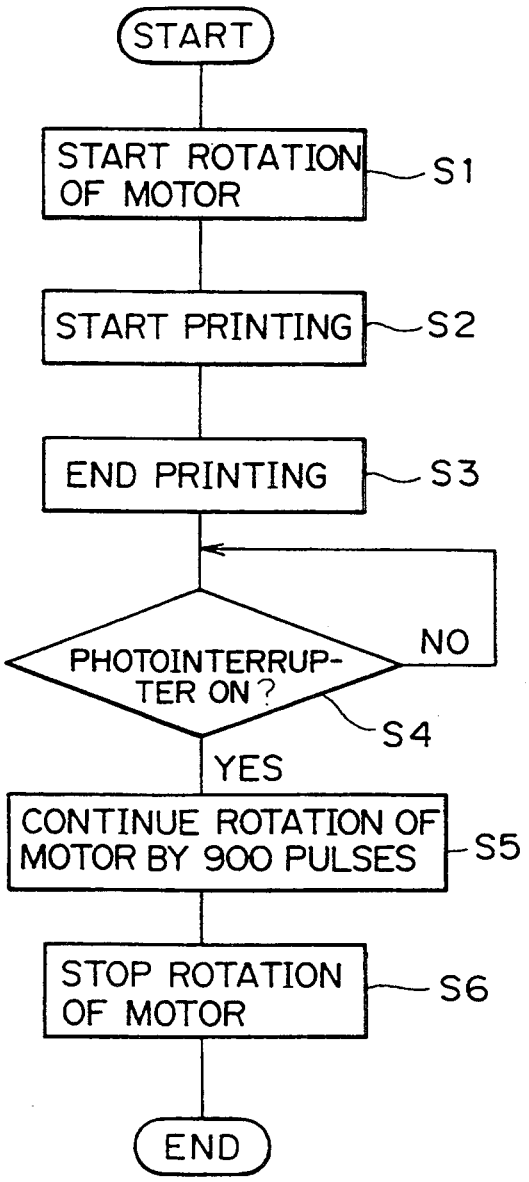
FIG. 11 is a flowchart showing the operation of the preferred embodiment of the present invention.

Referring to FIG. 10, there is schematically shown a control system of the preferred embodiment according to the present invention. An MPU 106 incorporated in a printer 112 receives a print start command, print data, etc. from a computer 108 connected to the printer 112 through an interface 110. When receiving the print start command from the computer 108, the MPU 106 feeds a rotation start command to the motor 58 to start driving the motor 58 for rotating the blade assemblies 46, and also feeds a print instruction command to the printer 112 to start printing.

When a print end command is input from the computer 108 to the MPU 106, a print end instruction command is fed from the MPU 106 to the printer 112. After a predetermined period of time, the printer 112 ends printing and feeds a print end response to the MPU 106.

Further, when the light shielding plate 82 is inserted between the light emitting diode 78 and the photodiode 80 of the photointerrupter 76, a signal is input from the photodiode 80 to the MPU 106 to control the pulse motor 58 so that the rotation of the pulse motor 58 may be stopped after a predetermined period of time.

The operation of the preferred embodiment mentioned above will be described with reference to FIGS. 10 and 11.

When a print start command is input from the computer 108 through the interface 110 to the MPU 106, a rotation start command is output from the MPU 106 to the motor 58, thereby starting the rotation of the motor 58 (step S1). Further, a print instruction command is output from the MPU 106 to the printer 112, thereby starting the printing (step S2).

When the motor 58 is driven, the arm 38 fixed to the output shaft 60 is rotated clockwise as viewed in FIG. 2, and the upper crank 34 is accordingly rotated clockwise. Since the lower crank 36 is connected through the pulley 72, the timing belt 64 and the pulley 62 to the output shaft 60 of the motor 58, the lower crank 36 is also rotated clockwise in synchronism with the rotation of the upper crank 34.

Since the blade assemblies 46 are rotatably mounted on the shaft 40 of the upper crank 34 and the shaft 44 of the lower crank 36, the blade assemblies 46 rotate with their vertically extending condition being kept. During the rotation of each blade assembly 46, the elastic blades 50 are moved downwardly on the outside of the paper guide 32 (i.e., while the elastic blades 50 are kept projecting from the openings **32*a* of the paper guide 32), thereby tapping the paper 12 at a perforated portion thereof to fold the paper 12 along the perforations thereof and stack the folded paper 12 on the table 28. Further, since the upper crank 34 and the lower crank 36 are synchronously rotated by the timing belt 64, the phases of the upper and lower cranks 34 and 36** can be kept identical with each other.

When a print end command is input from the computer 108 through the interface 110 to the MPU 106, a print end instruction command is output from the MPU 106 to the printer 112 to end the print operation after a predetermined period of time (step S3). After the print operation is ended, the rotation of the motor 58 is controlled by the MPU 106 so that each rotational tapping mechanism 30 may be stopped at the retracted position as shown in FIG. 2 (the retracted position of the right-hand mechanism 30 only being shown for convenience).

That is, it is determined whether or not the light shielding plate 82 is inserted between the light emitting diode 78 and the photodiode 80 after the end of the print operation (step S4). In this preferred embodiment, when the light shielding plate 82 is inserted between the light emitting diode 78 and the photodiode 80, the photointerrupter 76 goes ON. After the photointerrupter 76 goes ON, the motor 58 continues to be rotated at an angle corresponding to 900 pulses (step S5), and is then stopped (step S6).

In this preferred embodiment, a step angle of the stepping motor 58 is set to 1.8°, and a reduction rate of the gear head 59 is set to 1/18. Accordingly, after 90° rotation of each blade assembly 46 by the 900 pulses, it is stopped. Even when a power source is turned off in a stop position of each blade assembly 46, the blade assembly 46 is locked in this stop position owing to a detent torque of the motor 58 and the reduction ratio of the gear head 59, and is prevented from being lowered by its own weight. Further, when the print operation is ended., the elastic blades 50 are always brought into separation from the paper 12. Accordingly, there is no possibility of the elastic blades 50 being deformed.

While FIG. 2 shows that the right-hand rotational tapping mechanism 30 only is stopped in the retracted position, the left-hand rotational tapping mechanism 30 is also controlled to be stopped in the retracted position simultaneously with the right-hand rotational tapping mechanism 30. Further, since each rotational tapping mechanism 30 is stopped in the retracted position such that the elastic blades 50 are retracted from the openings 32*a* of the paper guide 32 to keep noncontact with the paper 12, the table 28 can be smoothly drawn to the front side of the unit 22, and the paper 12 stacked on the table 28 can be easily taken out.

As described above, the continuous paper folding unit 22 can eliminate a driving mechanism for vertically moving the table 28, so that the unit 22 can be provided at a relatively low cost with a high reliability. Further, the motor 58 for rotating the blade assemblies 46 is controlled so that when the printing is ended, the blade assemblies 46 are stopped in the retracted position. Accordingly, it is possible to prevent that the paper 12 stacked on the table 28 may be caught by the elastic blades 50 to cause cutting of the paper 12 upon removing the paper 12 from the table 28.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A continuous paper folding device for folding a continuous paper having perforations along which said paper is to be folded, comprising:

a frame;

a table movable between a storing position where said continuous paper is to be received by said table and a drawn position where said table is drawn from said storing position; and a pair of rotational tapping mechanisms provided on both sides of said table, for rotationally tapping said continuous paper received by said table to forcibly fold said continuous paper along said perforations;

each of said rotational tapping mechanisms comprising:

an upper crank comprising a pair of first arms spaced from each other and a first shaft connecting said first arms;

a lower crank comprising a pair of second arms spaced from each other and a second shaft connecting said second arms;

a blade assembly vertically extending and having a plurality of elastic blades vertically spaced from each other, said blade assembly being rotatably mounted on said first shaft of said upper crank and said second shaft of said lower crank; and driving means for synchronously rotating said upper crank and said lower crank.

2. A continuous paper folding device according to claim 1, wherein said blade assembly comprises a plurality of blade assemblies spaced from each other in an axial direction of said first and second shafts.

3. A continuous paper folding device according to claim 2, wherein said blade assemblies are rotated by said driving means between an advanced position where said elastic blades tap said paper and a retracted position where said elastic blades are kept in noncontact with said paper.

4. A continuous paper folding device according to claim 3, further comprising control means for controlling said each rotational tapping mechanism so that when printing is ended, each of said blade assemblies is rotated to said retracted position.

5. A continuous paper folding device according to claim 3, further comprising a pair of paper guiding members provided on both sides of said table, each of said paper guiding members having a plurality of vertically extending openings for allowing pass of said elastic blades of each of said blade assemblies.

6. A continuous paper folding device according to claim 5, wherein said driving means comprises:

a timing belt connecting said upper crank and said lower crank; and a motor having an output shaft fixed to at least one of said upper crank and said lower crank.

7. A continuous paper folding device according to claim 1, further comprising a pair of slide rail assemblies for guiding movement of said table, each of said slide rail assemblies comprising a fixed rail fixed to said frame, an inner slide rail slidably engaged with said fixed rail, and an outer slide rail slidably engaged with said inner slide rail and fixed to said table.

8. A continuous paper folding device according to claim 7, further comprising locking means for releasably locking said table in said storing position.

* * * * *